US005097771A

United States Patent [19]

James, III

[11] Patent Number: 5,097,771

[45] Date of Patent: Mar. 24, 1992

[54] WALL-MOUNTED SHELF UNIT

[76] Inventor: J. Hatcher James, III, 4205 Rowan Dr., Fort Worth, Tex. 76116

[21] Appl. No.: 638,193

[22] Filed: Jan. 7, 1991

[51] Int. Cl.[5] ..... A47B 23/00

[52] U.S. Cl. ..... 108/42; 108/108; 108/152; 211/90; 312/247

[58] Field of Search ..... 108/42, 144, 152, 108; 248/243, 250; 312/247; 211/90

[56] References Cited

U.S. PATENT DOCUMENTS

| | | | |
|---|---|---|---|
| 3,265,344 | 8/1966 | Ornstein | 108/152 X |
| 3,311,073 | 3/1967 | Colledge | 248/243 X |
| 3,347,187 | 10/1967 | Khoury | 108/108 X |
| 3,432,134 | 3/1969 | Forschmidt | 211/90 X |
| 3,604,670 | 9/1971 | Reeves | 248/250 |
| 3,634,983 | 1/1972 | Welch | 108/152 X |
| 3,645,486 | 2/1972 | Ferdinand et al. | 248/243 |
| 3,729,113 | 1/1973 | Lopatka | 312/247 X |
| 4,381,715 | 5/1983 | Forman | 108/108 X |
| 4,550,893 | 11/1985 | Wiersema et al. | 248/243 X |
| 4,928,833 | 5/1990 | Huizenga | 211/90 X |

*Primary Examiner*—Peter A. Aschenbrenner

*Attorney, Agent, or Firm*—Geoffrey A. Mantooth; Arthur F. Zobal; James C. Fails

[57] ABSTRACT

A shelf unit includes side panels and top and bottom shelves that extend between the side panels. The shelves are coupled to the side panels. The side panels each have plural interior cavities that are open at the rear edges of the side panels. The cavities are adapted to receive wall mounting brackets that project out from a wall. The rear edge of each side panel has a channel for receiving a shelf standard or wall mounting strip. The shelf unit is installed onto a wall by pushing the unit towards the wall, with the brackets being received by the cavities and the mounting strips being received by the channels. When installed, the mounting hardware is concealed from view. Another embodiment utilizes side panels without interior cavities. Instead, the side panels each have a channel along their respective rear edges. Wall standards, having keyhole shaped slots, are received by the channels. Fasteners are located in each channel and are coupled to the side panel. The fasteners have head portions and shank portions that are received by the wall standard slots.

12 Claims, 4 Drawing Sheets

WALL-MOUNTED SHELF UNIT

FIELD OF THE INVENTION

The present invention relates to wall-mounted furniture having shelves.

BACKGROUND OF THE INVENTION

Shelf furniture is of course used for many purposes For example, stores may use shelf furniture to display their goods or other items. Shelves may also be used for storage, bookshelves, etc. Wall-mounted shelves are popular because of the stability provided by the wall mounting. Also, wall-mounted shelves may be elevated up off of the floor, freeing up the floor space beneath the shelves for either storage of non-shelf items or for aesthetic reasons.

Prior art wall-mounted shelf furniture is exemplified by the following U.S. Pat. Nos.: Ferdinand et al. 3,563,626; Little 2,661,993 and Winter et al. 4,854,535. The shelves are supported by brackets that are mounted to vertical strips. The vertical strips are mounted to a wall. The unsightly mounting hardware is visible and greatly detracts from the aesthetics of the shelving.

In addition to unsightliness, another problem with the prior art is that much of the hardware for mounting the shelves to a wall is nonstandard mounting hardware. Such hardware is exemplified by U.S. Pat. Nos.: Wilson 4,733,841; Boundy et al. 4,013,254 and Reiter 3,744,868. The types of mounting hardware shown in these patents are too complicated and expensive.

SUMMARY OF THE INVENTION

It is an object of the present invention to provide wall-mounted shelf furniture that is aesthetic in appearance in that the wall mounting hardware is obscured from view.

It is a further object of the present invention to provide wall-mounted shelf furniture that uses simple conventional mounting hardware.

The shelving unit of the present invention is adapted to be mounted onto a wall having plural brackets extending outwardly from the wall. The unit includes two side panels that are adapted to be vertically oriented when mounted on the wall. Each of the side panels has top and bottom edge portions and front and rear edges. A top shelf extends between the side panels. The top shelf has two end portions that are respectively coupled to the side panels. A bottom shelf also extends between the side panels. The bottom shelf has two end portions that are respectively coupled to the side panels, wherein the top and bottom shelves and the side panels form a rigid structure. Each of the side panels has plural interior cavities. Each of the cavities opens to the exterior of the respective side panel at a location on the respective rear edge. Each of the cavities is adapted to receive one of the wall brackets. Each of the cavities is defined by an upper bearing surface and two lateral surfaces in the respective side panel. The bearing surfaces are adapted to bear on the respective wall brackets such that the side panels are supported by the wall brackets when the unit is mounted on the wall. The lateral surfaces are adapted to be located adjacent to and laterally of the respective wall bracket so as to prevent lateral movement of the unit when the unit is mounted onto the wall.

The shelf unit provides a rigid, stable structure that is wall-mounted. The shelves are mounted to the wall by way of the side panels. The shelves and the side panels are coupled together to form a rigid box-like structure.

In one aspect of the present invention, each of the side panels has a channel formed in the respective rear edge. The channel extends between the top and bottom edge portions of the respective side panel. The channels are adapted to receive a vertical wall mounting strip when the unit is mounted onto the wall, wherein the rear edges of the side panels can contact the wall.

In another aspect, each of the bearing surfaces in the interior cavities has a recess located near the front edge of the respective side panel. The recesses communicate with the respective interior cavities and are adapted to receive locking means on the wall brackets when the unit is mounted onto the wall.

With the shelf unit of the present invention, shelves can be mounted to a wall so that all of the mounting hardware is concealed from view within the side panels. Thus, there is no distraction from the aesthetics of the side panels and the shelves, which distraction would be caused by unsightly mounting hardware. Furthermore, the shelf unit is able to contact the wall by virtue of recesses which receive all of the mounting hardware. This gives the shelf unit a built-in look. Furtherstill, the shelf unit is easily installed onto a wall by simply engaging the wall brackets into the cavities and pushing towards the wall.

In another aspect, the shelf unit comprises at least two side panels that are adapted to be vertically oriented when mounted on a wall. Each of the side panels has a rear edge and top and bottom end portions. A top shelf extends between the side panels. The top shelf has two end portions that are respectively coupled to the side panels. A bottom shelf extends between the side panels and has two end portions that are respectively coupled to the side panels, wherein the top and bottom shelves and the side panels form a rigid structure. Each of the side panels has a channel located in the respective rear edge. Each channel extends between the respective top and bottom end portions. Plural wall coupling means that are adapted for coupling to the wall are provided. Each of the wall coupling means are received by a respective one of the rear edge channels. Each of the wall coupling means has plural slots therein. Each of the slots has a wide portion and a narrow portion. Each of the wall coupling means is oriented so that the respective slot wide portions are closer to the respective side panel top end portion than are said respective slot narrow portions. Each of the side panels has plural fastening means for fastening the side panels to the wall coupling means. Each of the fastening means is located in the respective rear edge channel. Each of the fastening means has a shank portion that is coupled to the respective side panel and that extends from the side panel and has a head portion coupled to the shank portion. Each of the head portions are received by a respective one of the slot wide portions, wherein when the side panels are mounted to the wall coupling means, the shank portions are received by the slot narrow portions.

In another aspect, the wall coupling means includes slotted wall standards and the fastening means include shoulder screw means.

DESCRIPTION OF PREFERRED EMBODIMENTS

Figure 1:
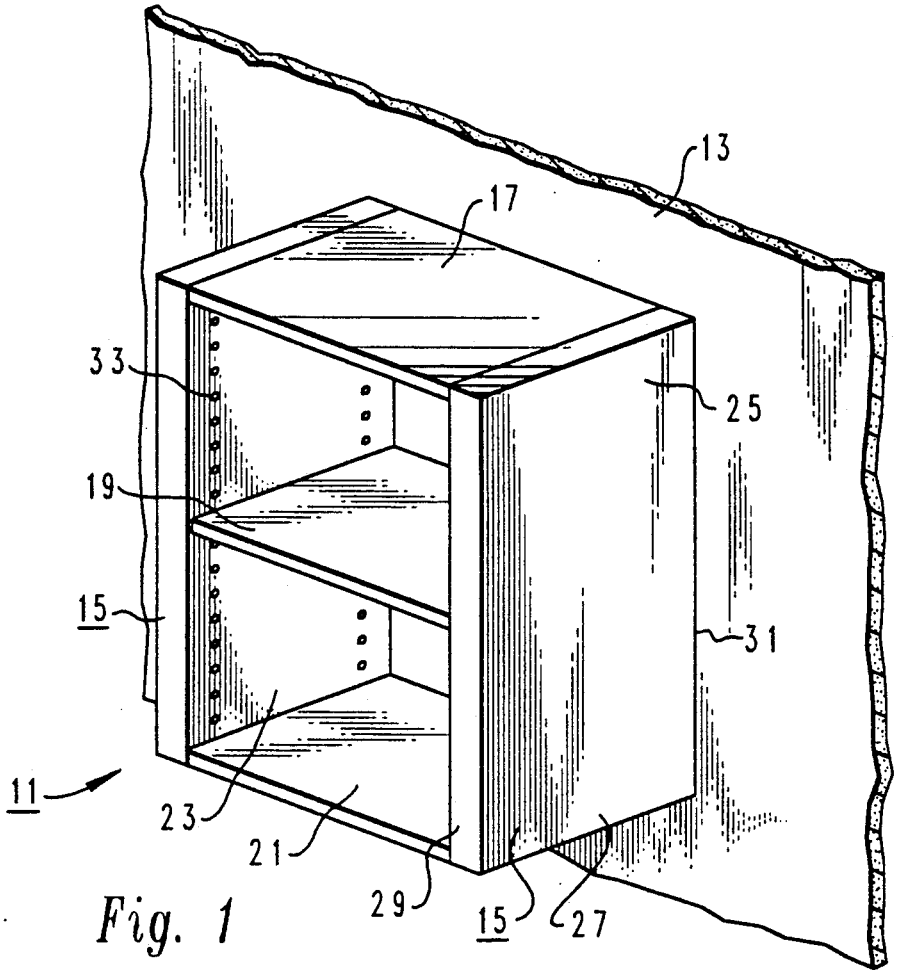
FIG. 1 is an isometric view of the shelf unit of the present invention, in accordance with a preferred embodiment, shown mounted onto a wall.

In FIG. 1, there is shown an isometric view of the shelf unit 11 of the present invention, in accordance with a preferred embodiment. The shelf unit 11 is shown mounted onto a wall 13. As such, the shelf unit may be located above the floor. The shelf unit includes at least two side panels 15 and plural shelves 17, 19, 21.

Each side panel 15 is generally rectangular, having an inside surface 23 that extends between top and bottom ends 25, 27. Each side panel also has front and rear edges 29, 31. The inside surface 23 of each side panel is perforated with two vertical rows of circular openings 33. The openings 33 receive conventional pegs (not shown) for supporting one or more shelves 19 inside of the unit. There is a row of openings 33 near the front edge 29 and a row near the rear edge 31. The openings allow the position of the interior shelf to be adjusted inside of the unit.

Figure 2:
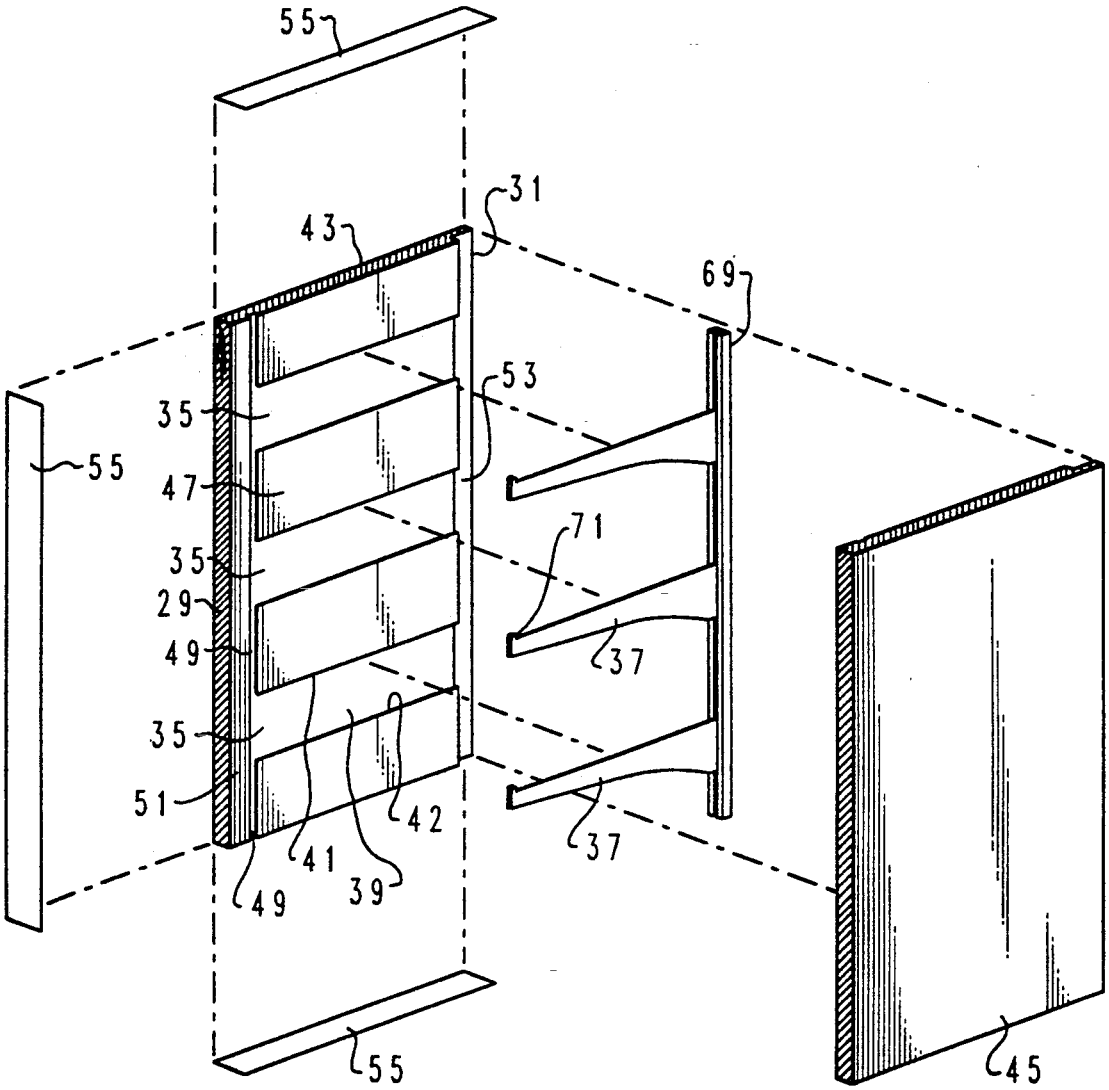
FIG. 2 is an exploded view of one of the side panels, shown with hardware.
Figure 6:
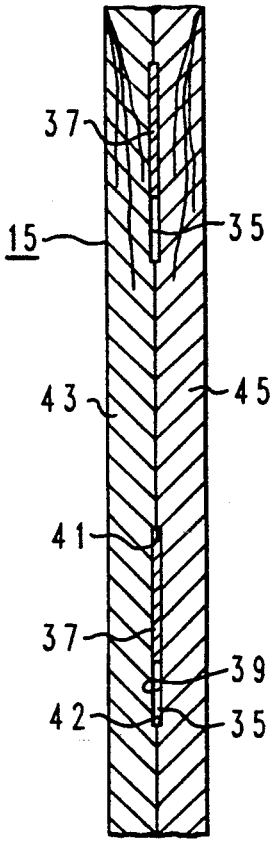
FIG. 6 is a cross-sectional view of one of the side panels, taken through lines VI—VI of FIG. 5.

Referring to FIGS. 2 and 6, each side panel 15 has plural interior cavities 35 for receiving the wall brackets 37. The cavities 35 open to the exterior at the rear edge 31 of each side panel. The ends of the cavities near the front edge 29 are closed, to hide the cavities and the mounting hardware located therein from view. The cavities are defined in part by side, top and bottom surfaces 39, 41, 42.

Figure 7:
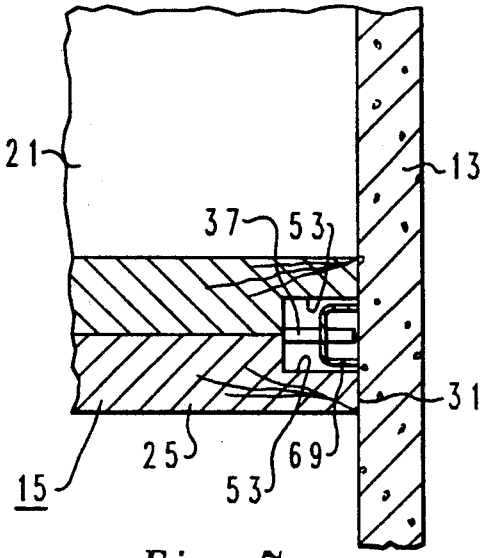
FIG. 7 is a detail cross-sectional view of the shelf unit taken through lines VII—VII of FIG. 5.

In the preferred embodiment, each side panel 15 is made up of first and second flat rectangular members 43, 45. The first member 43 has plural shallow dados 35 therein, extending from the rear edge 31 to near the front edge 29. The dadoed areas form the cavities 35. The rectangular spacer blocks 47 between the cavities form the top surfaces 41 that bear on the wall brackets 37 when the wall brackets are inserted into the cavities. The spacer blocks 47 also form the bottom surfaces 42. The spacer blocks 47 contact the second member 45 when the first and second members 43, 45 are coupled together. The first member 43 also has a narrow, shallow groove 49, or dado, extending from the top end 25 to the bottom end 27 and located near the front edge 29 (see FIGS. 2 and 5). The groove 49 intersects the front portions of the cavities 35. A front spacer block 51 is thus formed between the groove 49 and the front edge 29 of the first member 43. The distance between the groove 49 and the rear edge 31 is such that then entire length of the wall brackets 37 can be received. The rear edges 31 of the members have rabbets 53 extending from the top ends 25 to the bottom ends 27. As shown in FIG. 7, when the members 43, 45 are assembled together, the rabbets 53 form an interior channel for receiving part of the mounting hardware 69. Either the second member 45, or the first member 43, or both members have the openings 33 for receiving the shelf support pegs. The first and the second members 43, 45 are assembled together such that the spacer blocks 47, 51 contact the second member, as shown in FIG. 6. Glue and/or fasteners are used to join the members 43, 45 together.

Figure 3:
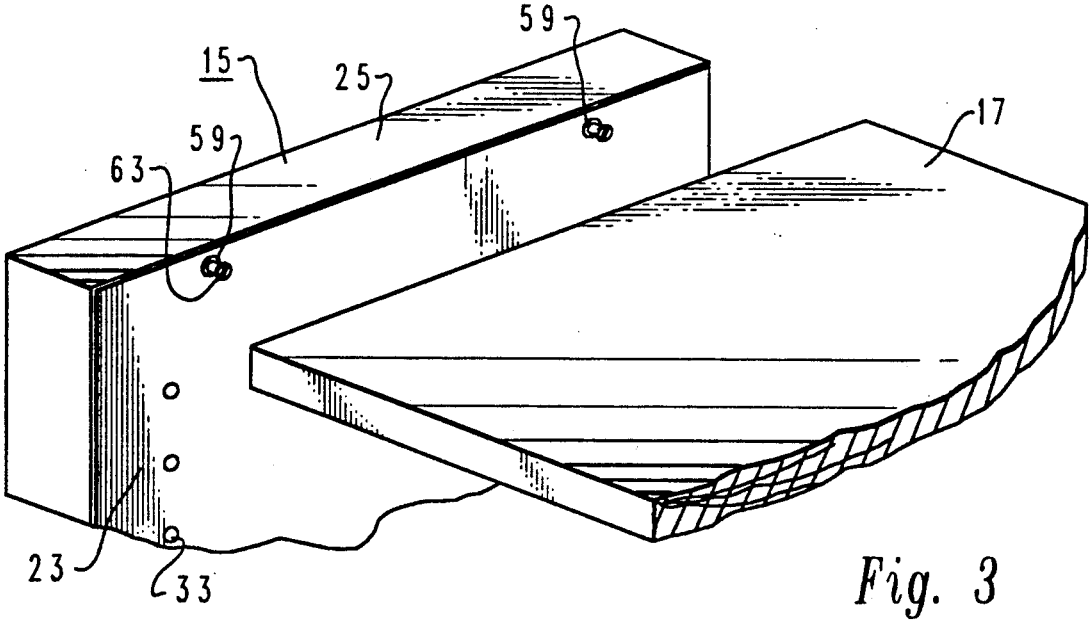
FIGS. 3 and 4 are exploded views, showing the mounting apparatus for coupling the end shelves to the side panels.
Figure 4:
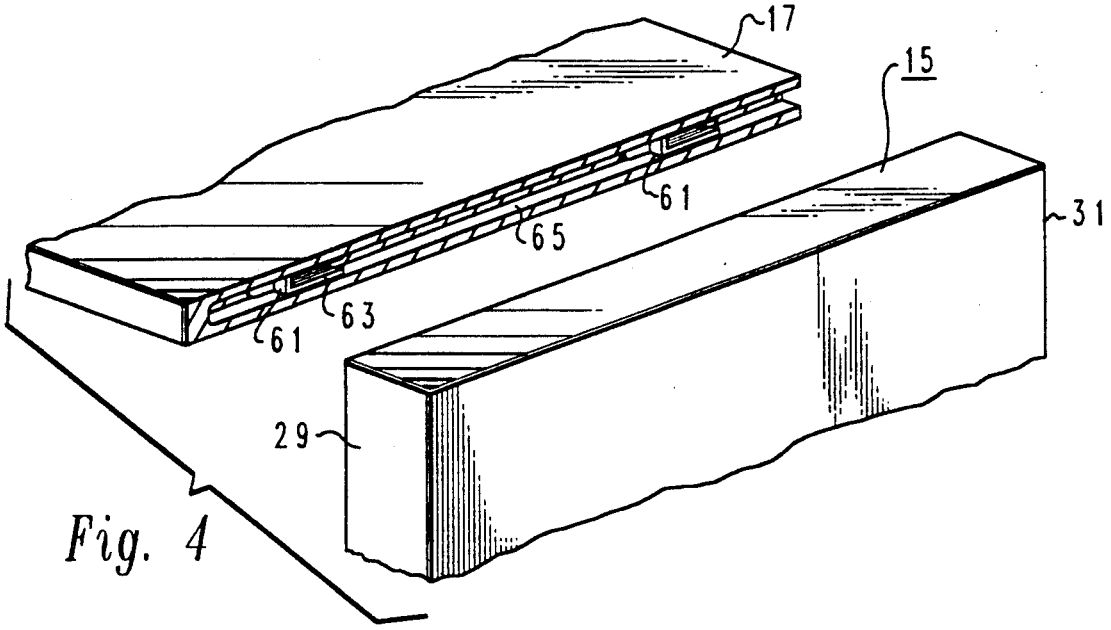

The shelves 17, 19, 21 span between the side panels 15. There is a top shelf 17, a bottom shelf 21 and one or more interior shelves 19. The shelves are flat rectangular members. The interior shelf 19 is mounted to the side panels 15 as described above. The top and bottom shelves 17, 21 are fixedly coupled to the side panels 15 so as to form a rigid four-walled box. For ease of assembly, in the preferred embodiment, the top and bottom shelves are removably locked to the side panels with conventional, commercially available locking mechanisms 57. Referring to FIGS. 3 and 4, each locking mechanism has a projection 59 and a retainer 61. The projections 59 are embedded in the side panels 15 near the top and bottom ends 25, 27, where they project from the respective inside surfaces 23 as shown in FIG. 3. The projections 59 each have a flanged head 63. The retainers 61 are located at the side ends of the top and bottom shelves 17, 21 as shown in FIG. 4. Each side end of the top and bottom shelves 17, 21 has a groove 65 extending along the side edge from the shelf rear edge to a point near the shelf front edge. The grooves 65 receive the retainers 61 and enable the side edges to abut against the side panels. The retainers 61 have slots 67 for receiving the projections 59 and a cavity behind each slot for receiving the heads 63.

To assemble the top and bottom shelves 17, 21 to the side panels 15, the side end of a shelf is placed up against a side panel such that the projections 59 are located in the groove 65 of a shelf. Then, the shelf is moved toward the rear edge 31 of the side panel, wherein the projections 59 enter the slots 67 and the heads 63 enter the cavities in a locking fit. When assembled, the shelf unit forms a rigid box-like structure with strong joints between the top and bottom shelves and the side panels (see FIG. 1). The top and bottom shelves 17, 21 are flush with the respective top, bottom, front and rear edges of the side panels 15.

In the preferred embodiment, the side panels and shelves are made of wood for aesthetics and for ease of manufacturing. The shelves are made of solid wood for strength. Caps 55 made of thin strips of veneer are glued along the top, bottom and front edges to cover the joint between the members 43, 45 of the side panels.

The shelf unit 11 is installed onto a wall 13 using conventional mounting hardware. In fact, the unit can be installed with widely available and inexpensive shelf standard hardware shown in FIG. 2. The hardware includes slotted standards 69 or mounting strips that are mounted to the wall 13 by fasteners. The standards 69 have plural slots therein for accepting mounting brackets 37. The slots allow the position of the brackets 37 along the strips to be adjusted up and down.

Two standards 69, one for each side panel 15, are mounted to the wall. Plural mounting brackets 37 are located on each standard. The brackets 37 on a standard 69 are spaced apart a distance equal to the distance between adjacent top surfaces 41. Installation of the unit 11 is simple: the unit is placed onto the mounting brackets 37 such that the brackets enter the cavities 35 through the openings in the side panel rear edges 31. The unit is then pushed toward the wall 13 until it abuts the wall, wherein it is installed.

Figure 5:
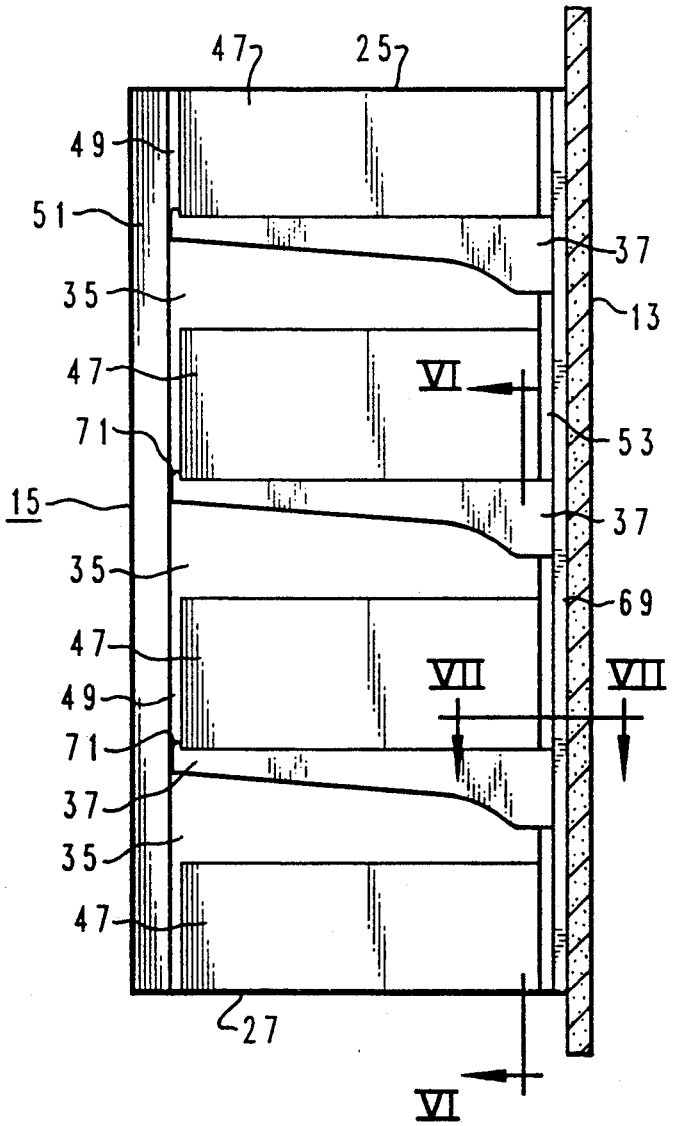
FIG. 5 is a side view of one of the side panel first members, showing how the mounting brackets are received by the cavities.

When the unit 11 is installed, the mounting brackets 37 are located in the cavities 35, as shown in FIGS. 5 and 6. The top surfaces 41 of the cavities bear on the tops of the mounting brackets 37. The side walls 39 of the cavities 35 are adjacent to the sides of the mounting brackets. Each mounting bracket 37 has a hook 71 that projects upwardly from its outer end. These hooks 71 are located in the front groove 49 so that the spacer blocks 47 are located between the hooks 71 and the mounting standard 69. Thus, the unit 11 is secured in a fore and aft direction. The unit is also secured in a lateral direction, as shown in FIG. 6, because the cavities 35 are only slightly wider than the mounting brackets 37. Any lateral movement is prohibited by the side walls 39 of the cavities 35 contacting the brackets 37. Also, any lateral movement is prevented by the groove 53 along the rear edges 31 which receives the respective standard 69. The unit is further stabilized because the rear edges of the side panels and the shelves contact the wall 13, as shown in FIG. 7. Thus, the shelf unit is able to bear against the wall with all of the side panels and shelves.

As shown in FIG. 1, after the unit 11 is installed onto a wall 13, the mounting hardware is concealed from view by the side panels 15. Thus, the shelf unit is aesthetically attractive and gives the appearance of high quality furniture. The appearance is enhanced by using furniture quality wood or veneer for the panels 15 and shelves. Furthermore, because the mounting standards are recessed into the side panels, the unit "hugs" the wall, giving the appearance of custom built shelving. Prior art shelves using shelf standard mounting hardware are unable to contact the wall, because the mounting strip is an obstacle. This leaves an unsightly gap between the shelves and the wall.

Although the shelf unit has been described with only two side panels, it may have more than two. A three-paneled unit would be wider than a two-paneled unit. The center panels would have openings on both sides for receiving the shelf supporting pegs.

Although the side panels 15 have been described of being made up of first and second members 43, 45 of uneven thickness, the side panels could be made up of members having equal thickness. Each member would have shallow dadoes 35 therein. When a first and second member are assembled together, the dadoes of the first member would align with the dadoes of the second member so as to form the interior cavities.

Figure 8:
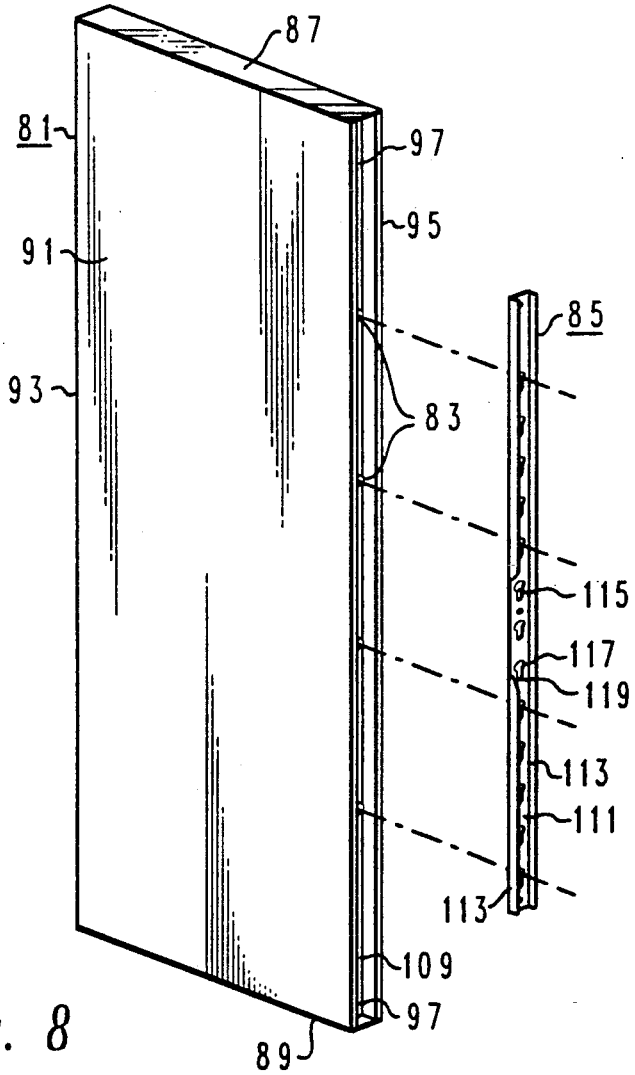
FIG. 8 is an isometric view of a side panel of the present invention, in accordance with another embodiment, with the wall standard partially broken away.

In FIG. 8, there is shown a side panel 81 of the shelf unit of the present invention in accordance with another embodiment. In lieu of interior cavities for receiving wall brackets, the side panel 81 has fastening means 83 that couple to a wall standard 85.

The side panel 81, which is generally rectangular, has top and bottom ends 87, 89, side surfaces 91 and front and rear edges 93, 95. The rear edge 95 has a channel 97 formed therein, which channel extends between the top and bottom ends 87, 89. The channel 97 is generally square in transverse cross-section. The channel 97 is deep enough to fully receive the wall standard 85 such that the rear edge 95 of the side panel will abut against the wall 13 onto which the shelf unit is mounted.

Figure 9:
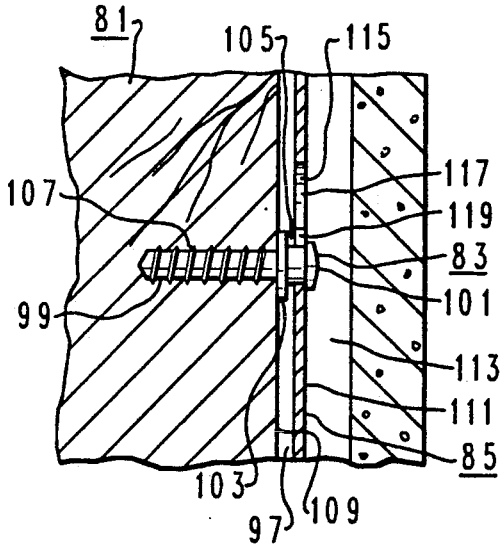
FIG. 9 is a cross-sectional view of the side panel of FIG. 8, showing a fastening screw engaged with a slot in the wall standard.

Plural fastening means 83 are provided in the channel 97. In the preferred embodiment, the fastening means comprise shoulder screws 83, which are shown in FIG. 9. Each shoulder screw 83 has a shank portion 99, a head portion 101 and a shoulder portion 103. The shoulder portion 103 is spaced slightly apart from the head portion 101 so as to form a gap 105. The shank portion 99 that is located between the head and shoulder portions 101, 103 is unthreaded. However, the shank portion is threaded 107 beyond the shoulder portion.

The shoulder screws 83 are screwed into the front surface 109 of the channel 97 such that the shoulder portion 103 abuts the front surface and the head portion 101 projects into the channel. Plural shoulder screws 83 are located along the length of the channel 97 as shown in FIG. 8.

The wall standard 85 is a metal strip having a central wall 111 and two side walls 113. The side walls 113 extend perpendicularly from the edges of the central wall 111 to form a "U" shaped strip. The central wall 111 has plural keyhole shaped slots 115 therein. Each slot 115 has a wide portion 117 and a narrow portion 119. The wide portion 117 is circular and is large enough to receive the head portion 101 of a shoulder screw 83. The narrow portion 119 is smaller than the head portion 101 of the shoulder screw but is large enough to receive the shank portion 99 of the shoulder screw. The shoulder screws 83 are spaced along the side panel channel at distances corresponding to the distances between the respective wall slots 115.

To make up a shelf unit, two or more of the side panels 81 are used, along with top, bottom and other shelves 17, 19, 21, as described above.

To install the shelf unit with the side panels 81 onto a wall, one wall standard 85 for each side panel 81 is mounted onto the wall 13 so as to be vertically oriented. The wall standards 85 are oriented so that the wide portions 117 of the slots are located above the narrow portions 119, wherein the wide portions 117 are located closer to the top end 87 of the side panel than are the respective narrow portions 119. Then, the side panels 81 are mounted onto the wall standards 85 such that the head portions 101 of the shoulder screws are inserted through the wide portions 117 of the respective slots 115. The side panels 81 are then allowed to drop slightly so that the shank portions 99 of the shoulder screws are located in the narrow portions 119 of the slots 115. As shown in FIG. 9, those portions of the central wall 111 of the wall standard 85 that are adjacent to the slot 115 are located in the gap 105 between the shoulder portion 103 and the head portion 101.

The shelf unit can be assembled onto the wall as a single unit or the side panels can be assembled onto the wall first, followed by assembly of the top, bottom and other shelves to the side panels. Once mounted onto the wall 13, the rear edges 95 of the side panels 81 contact the wall. The wall standards 85 are hidden from view by virtue of their being recessed in the channels 97.

The foregoing disclosure and showings made in the drawings are merely illustrative of the principals of this invention and are not to be interpreted in a limiting sense.

I claim:

1. A shelving unit adapted to be mounted onto a wall having plural brackets extending outwardly from said wall, comprising:

a) two side panels adapted to be vertically oriented when mounted on said wall, each of said side panels having top and bottom edge portions and front and rear edges;

b) a top shelf extending between said side panels, said top shelf having two end portions that are respectively coupled to said side panels;

c) a bottom shelf extending between said side panels, said bottom shelf having two end portions that are respectively coupled to said side panels, wherein said top and bottom shelves and said side panels form a rigid structure;

d) each of said side panels having plural interior cavities, each of said cavities opening to the exterior of said respective side panel at a location on said respective rear edge, each of said cavities being adapted to receive one of said wall brackets, each of said cavities being defined by an upper bearing surface and two lateral surfaces in said respective side panel, said bearing surfaces being adapted to bear on said respective wall brackets such that said side panels are supported by said wall brackets when said unit is mounted onto said wall, said lateral surfaces being adapted to be located adjacent to and laterally of said respective wall brackets so as to prevent lateral movement of said unit when said unit is mounted onto said wall, wherein said brackets are concealed from view inside of said side panel cavities when said unit is mounted onto said wall.

2. The shelving unit of claim 1 wherein each of said side panels has a channel formed in said respective rear edge, said channel extending between said top and bottom edge portions of said respective side panel, said channel being adapted to receive a vertical wall mounting strip when said unit is mounted onto said wall, wherein said rear edges of said side panels can contact said wall.

3. The shelving unit of claim 2 wherein each of said bearing surfaces in said interior cavities have a recess located near the front edge of said respective side panel, said recesses communicating with said respective interior cavities, said recesses being adapted to receive locking means on said wall brackets when said unit is mounted on said wall.

4. The shelving unit of claim 1 wherein each of said bearing surfaces in said interior cavities have a recess located near the front edge of said respective side panel, said recesses communicating with said respective interior cavities, said recesses being adapted to receive locking means on said wall brackets when said unit is mounted on said wall.

5. A shelving unit adapted to be mounted onto a wall having plural brackets extending outwardly therefrom, comprising:

a) plural side panels adapted to be vertically oriented when mounted on said wall, each of said side panels having front and rear edges;

b) plural shelves extending between said side panels, said plural shelves comprising upper and lower shelves, said upper and lower shelves each being coupled to said side panels;

c) each of said side panels comprising first and second wall portions, said first and second wall portions being generally parallel to each other;

d) for each side panel said first and second wall portions being coupled together such that plural spacer means are interposed between said first and second wall portions, said spacer means being spaced apart from each other so as to create plural cavities bounded by said first and second wall portions and adjacent spacer means, said cavities being open to the exterior of said respective side panels at said rear edge of said respective side panels and closed at said front edge of said respective side panels, each of said cavities being adapted to receive one of said wall brackets with each of said spacer means being adapted to bear on a respective one of said respective wall brackets, wherein said brackets are concealed from view inside of said side panels when said unit is mounted onto said wall.

6. The shelving unit of claim 5 wherein each of said side panels has a channel formed in said respective rear edge, said channel extending between top and bottom edge portions of said respective side panel, said channel being adapted to receive a vertical wall mounting strip when said unit is mounted onto said wall, wherein said rear edges of said side panels can contact said wall.

7. The shelving unit of claim 6 further comprising recesses interposed between said spacer means and said front edge of said respective side panels, said recesses communicating with said respective interior cavities, said recesses being adapted to receive locking means on said wall brackets when said unit is mounted onto said wall.

8. The shelving unit of claim 7, further comprising coupling means for removably coupling said upper and lower shelves to said side panels.

9. The shelving unit of claim 5 further comprising recesses interposed between said spacer means and said front edge of said respective side panels, said recesses communicating with said respective interior cavities, said recesses being adapted to receive locking means on said wall brackets when said unit is mounted onto said wall.

10. A shelving system, comprising:

a) plural side panels adapted to be vertically oriented when mounted on a wall, each of said side panels having front and rear edges;

b) plural shelves extending between said side panels, said plural shelves comprising upper and lower shelves, said upper and lower shelves each being coupled to said side panels;

c) each of said side panels comprising first and second wall portions, said first and second wall portions being generally parallel to each other;

d) wall mounting means for mounting said side panels to a wall, said wall mounting means comprising vertically oriented mounting strips that are adapted to be mounted onto said wall and wall brackets that couple to said mounting strips and extend outwardly from said wall;

e) for each side panel said first and second wall portions being coupled together such that plural spacer means are interposed between said first and second wall portions, said spacer means being spaced apart from each other so as to create plural cavities bounded by said first and second wall portions and adjacent spacer means, said cavities being open to the exterior of said respective side panels at said rear edge of said respective side panels and closed at said front edge of said respective side panels, each of said cavities receiving one of said wall brackets with each of said spacer means bearing on said respective wall brackets, wherein said brackets are concealed from view inside of said side panels.

11. A shelving unit, comprising:

a) at least two side panels adapted to be vertically oriented when mounted on a wall, each of said side panels having a rear edge and top and bottom end portions;

b) a top shelf extending between said side panels, said top shelf having two end portions that are respectively coupled to said side panels;

c) a bottom shelf extending between said side panels, said bottom shelf having two end portions that are respectively coupled to said side panels, wherein said top and bottom shelves and said side panels form a rigid structure;

d) each of said side panels having a channel located in said respective rear edge, said channel extending between said respective top and bottom end portions;

e) plural wall coupling means that are adapted for coupling to said wall, each of said wall coupling means being received by a respective one of said rear edge channels, each of said wall coupling means having plural slots therein, each of said slots having a wide portion and a narrow portion, each of said wall coupling means being oriented so that said respective slot wide portions are closer to said respective side panel top end portion than are said respective slot narrow portions;

f) each of said side panels having plural fastening means for fastening said side panels to said wall coupling means, each of said fastening means being located in said respective rear edge channel, each of said fastening means having a shank portion that is coupled to said respective side panel and that extends from said side panel and having a head portion coupled to said shank portion, each of said head portions being received by a respective one of said slot wide portions, wherein when said side panels are mounted to said wall coupling means, said shank portions are received by said slot narrow portions.

12. The shelving unit of claim 11 wherein said wall coupling means comprise slotted wall standards and said fastening means comprise shoulder screw means.

* * * * *